US007109871B2

(12) United States Patent
Lentine et al.

(10) Patent No.: US 7,109,871 B2
(45) **Date of Patent: *Sep. 19, 2006**

(54) SKIER ALERT SYSTEM WITH FALLEN SKIER ALARM

(75) Inventors: Gregory E. Lentine, Orlando, FL (US); Louis F. Lentine, Jr., Windermere, FL (US)

(73) Assignee: NorCross Marine Products, Inc., Orlando, FL (US)

( * ) Notice: Subject to any disclaimer, the term of this patent is extended or adjusted under 35 U.S.C. 154(b) by 40 days.

This patent is subject to a terminal disclaimer.

(21) Appl. No.: 10/970,369

(22) Filed: Oct. 21, 2004

(65) Prior Publication Data

US 2005/0073442 A1 Apr. 7, 2005

Related U.S. Application Data

(63) Continuation-in-part of application No. 10/378,540, filed on Mar. 3, 2003, now Pat. No. 6,822,572, which is a continuation-in-part of application No. 09/845,055, filed on Apr. 27, 2001, now Pat. No. 6,603,402.

(51) Int. Cl.
*G08B 23/00* (2006.01)

(52) U.S. Cl. ..... 340/573.6; 340/539.1; 340/604; 340/984

(58) Field of Classification Search ..... 340/573.6, 340/665, 539.1, 984, 604
See application file for complete search history.

(56) References Cited

U.S. PATENT DOCUMENTS

| | | | | |
|---|---|---|---|---|
| 3,983,483 | A | 9/1976 | Pando | 325/16 |
| 4,483,683 | A | 11/1984 | Alley, Sr. | 441/69 |
| 4,624,141 | A | 11/1986 | Soleau | 73/865.8 |
| 4,689,611 | A | 8/1987 | Franklin | 340/539 |
| 4,934,972 | A | 6/1990 | Shumway et al. | 441/69 |
| 5,041,040 | A | 8/1991 | Jones et al. | 441/69 |
| 5,043,727 | A | 8/1991 | Ito | 340/984 |
| 5,167,550 | A | 12/1992 | Nielsen | 440/84 |
| 5,343,189 | A | 8/1994 | Alley, Sr. | 340/539 |
| 5,385,110 | A | 1/1995 | Bennett et al. | 114/285 |
| 5,408,221 | A | 4/1995 | Carsella, Sr. et al. | 340/604 |
| 5,694,337 | A | 12/1997 | Macken | 364/559 |
| 5,838,227 | A | 11/1998 | Murray | 340/425.5 |
| 6,603,402 | B1 | 8/2003 | Lentine et al. | 340/573.6 |

FOREIGN PATENT DOCUMENTS

| | | |
|---|---|---|
| DE | 42 20 134 A1 | 12/1993 |
| WO | 93/00258 | 1/1993 |

*Primary Examiner*—Thomas Mullen

(57) ABSTRACT

A water skier tow bar assembly includes a tow bar handle and control actuators that can be actuated by a user and indicative of a desired skier condition. A housing is connected to the tow bar and includes a wireless radio transmitter operatively connected to the control actuators for generating wireless radio signals of desired skier conditions or generating wireless radio signals indicative of a skier down condition. In one aspect of the invention, a wireless radio transmitter is contained in a housing formed as a float assembly and has an aperture through which a tow rope passes to permit the housing to be carried by a tow rope. When a skier falls, a water actuated switch initiates transmission of a wireless radio signal indicative of a skier down condition.

13 Claims, 14 Drawing Sheets

SKIER ALERT SYSTEM WITH FALLEN SKIER ALARM

RELATED APPLICATION

This application is a continuation-in-part application based upon prior filed copending continuation-in-part application Ser. No. 10/378,540, filed Mar. 3, 2003, now U.S. Pat. No. 6,822,572, which is a continuation-in-part-application of Ser. No. 09/845,055 filed April 27, 2001, now U.S. Pat. No. 6,603,402, the disclosures which are hereby incorporated by reference in their entirety.

FIELD OF THE INVENTION

This invention relates to water skier safety devices, and more particularly, this invention relates to wireless water skier alert systems.

BACKGROUND OF THE INVENTION

Water skiing is becoming a popular past time and recreational activity. It requires not only a boat operator driving a boat towing a water skier via a rope and tow bar handle secured thereto, but also an observer positioned in the boat as a passenger, who constantly monitors the water skier performance. The observer notes to the water skier whether the water skier indicates a desire for changed water skier conditions, such as speeding up, slowing down, or turning around, or has fallen and requires the boat to return and pull the water skier back up out of the water either into a skiing position, or draw the skier into the safety of the boat.

When an observer is not available, it is necessary to include a device to apprise immediately a boat operator if a skier has fallen or voluntarily released hold of the ski rope. This is necessary to ensure that the boat operator does not continue driving the boat a long distance from the location where the water skier has fallen, and thus, placing the water skier into a dangerous position where other boats could run over him or her. Some systems use a wire extending from a water skier tow bar handle to an alarm positioned within the boat indicating when a skier has fallen. This could be accomplished, such as when the tow bar handle hits the water and blocks a signal generated from a transmitter. Other systems, such as disclosed in U.S. Pat. No. 4,689,611, use a wireless transmitter for generating a signal that generates an alarm after the skier lets go of the tow bar handle. In these systems, a pre-selected frequency is no longer transmitted and an alarm is activated by closure of a switch.

Other systems use complicated tow bar handles, such as disclosed in U.S. Pat. No. 4,483,683, teaching a complicated handle assembly with on/off switches and manually actuated trigger switches. U.S. Pat. No. 5,408,221 discloses a downed water skier warning system using electronic water sensors for sensing when the rope-handle of the skier tow-rope lands in the water. These water and pressure sensors are in remote communication with audible and visual tow boat operator alarms and visual "skier down" warning indicators.

Commonly assigned U.S. Pat. No. 6,603,402 overcomes these prior art problems such that the standard cylindrically configured and longitudinally extending tow bar handle is used with a skier alert system to generate not only an indication of a "skier down" signal, but also generate other signals that indicate a desired water skier condition, such as speeding up, slowing down, a directional turning around, or stop. This system provides for the boat operator to know when a skier down condition has occurred and when any change occurs in desired water skier conditions.

Commonly assigned Continuation-in-Part patent application Ser. No. 10/378,540, filed Mar. 3, 2003, discloses a water skier tow bar and float assembly in which the tow bar handle includes control actuators positioned along the grip and a float assembly connected to the tow bar handle. The float assembly could be integral with the tow bar handle. The wireless radio transmitter is mounted within the float assembly and operatively connected to the control actuators for generating wireless signals of desired water skier conditions based on user actuation of the control actuators.

SUMMARY OF THE INVENTION

The present invention offers some improvements and also permits "skier down" conditions to be more readily indicated in some instances. In one aspect of the present invention, a water skier tow bar assembly includes a tow bar handle and control actuators positioned along the tow bar handle and actuated by a user and indicative of a desired skier condition. A housing is connected to the tow bar handle. A wireless radio transmitter is mounted within the housing and operatively connected to the control actuators for generating wireless radio signals of desired skier conditions or generating wireless radio signals indicative of a skier down condition. The housing can be formed integral with the tow bar handle, or separate, and together form a triangular configured water skier tow bar assembly.

In one aspect of the present invention, wireless radio signals are transmitted based on user actuation of the control actuators, or transmitted when a skier falls indicative as a skier down condition. A switch can be operative with the wireless radio transmitter and triggers the wireless radio transmitter to transmit wireless radio signal indicative of a skier down condition.

In another aspect of the present invention, the wireless radio transmitter is operable for transmitting a wireless radio signal on a single RF channel. The radio transmitter can include an address code as an identifier different from other wireless radio transmitters.

In yet another aspect of the present invention, the water skier alert system includes a radio receiver adapted to be positioned on the boat towing the water skier. It receives wireless radio signals transmitted from the tow bar assembly that are indicative of a skier down condition or a desired water skier condition. An indicator is operative with the receiver and indicates a skier down condition or desired water skier condition. This indicator could be an alarm, which produces audible tones, or a display on the receiver for displaying an indication of the desired water skier condition or the skier down condition. An address code can identify the receiver to distinguish it from other receivers and allow it to receive wireless radio signals from the tow bar assembly wireless radio transmitter that is set to the same code.

A housing for the wireless radio transmitter can support the wireless radio transmitter and be configured to be carried by a tow rope. For example, the housing could be formed as float assembly that has a hole through which a tow rope passes. A water activated switch can be carried by the wireless radio transmitter on the housing and trigger the wireless radio transmitter to transmit a wireless radio signal indicative of a skier down condition when a skier falls. For example, a wrist strap could engage the switch and be held by a skier, for example, looped around the skier's wrist. When the skier fell, the wrist strap would pull the switch and initiate the wireless radio signal transmission indicative of the skier down condition. The float assembly could also be integral with a tow bar handle or work in conjunction with the tow bar handle.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
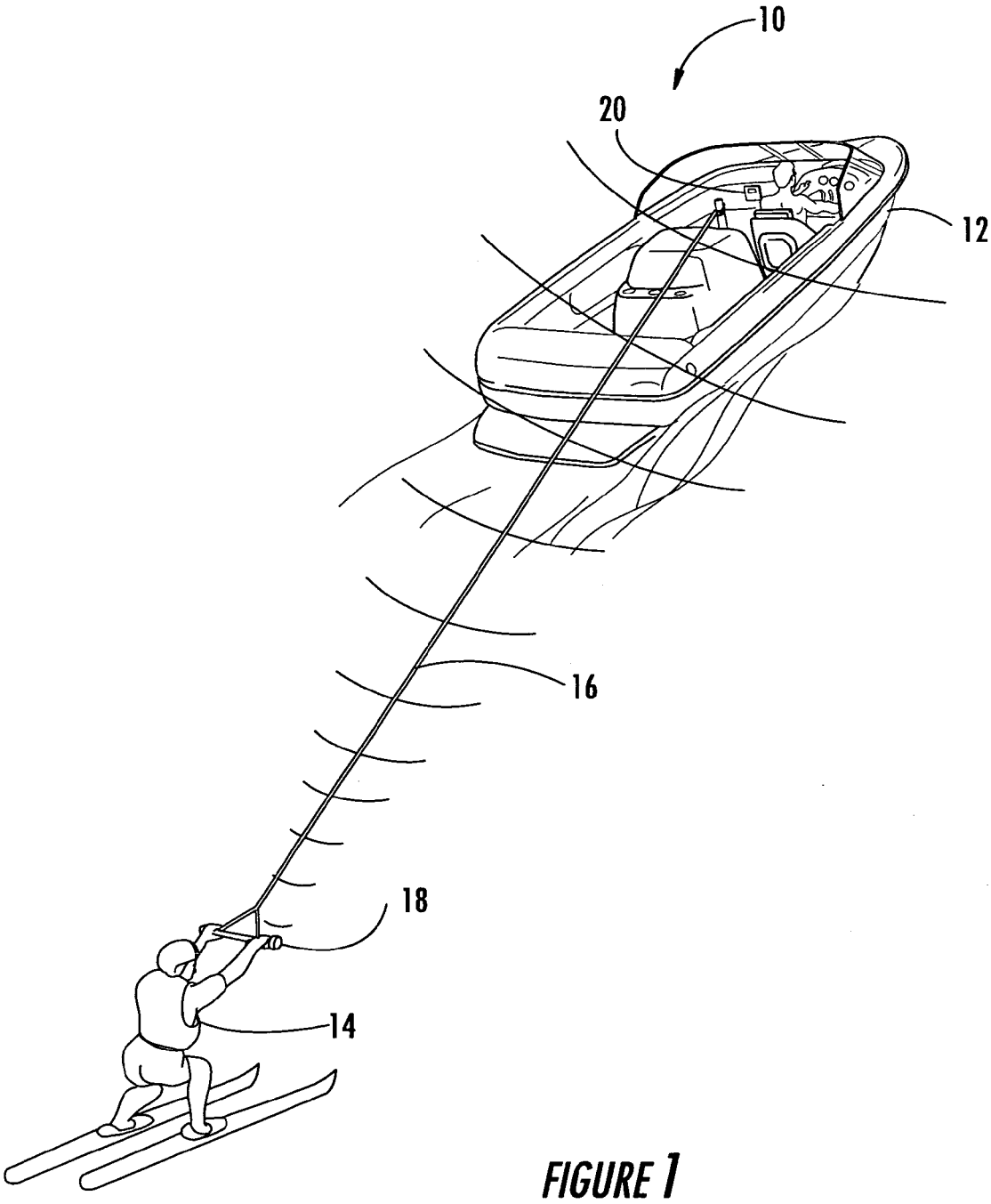
FIG. 1 illustrates a schematic, environmental view of the use of the water skier alert system in a first embodiment and showing various components of the system, including the water skier tow bar handle assembly and radio receiver and display unit positioned within a boat.

FIG. 1 illustrates an overall environmental view of a water skier alert system 10 of a first embodiment and showing a boat 12 towing a water skier 14 via a rope 16 and tow bar handle 18 secured thereto. For purposes of this description, the term "water skier" describes any user of the skier alert system, such as a user being pulled on a raft or other means. The boat 12 includes only a boat operator (shown in phantom lines) and no observer to observe the water skier for a "skier down" condition, such as when the water skier has fallen, or an indication from the water skier of a desire to change water skier conditions, such as turning around, speeding up, stopping or slowing down. The water skier alert system 10 includes a wireless radio receiver and display unit 20 that is positioned on the boat towing the water skier and receives wireless radio signals transmitted from the tow bar handle 18 in response to a skier down condition or water skier actuation of a desired water skier condition.

Figure 5:
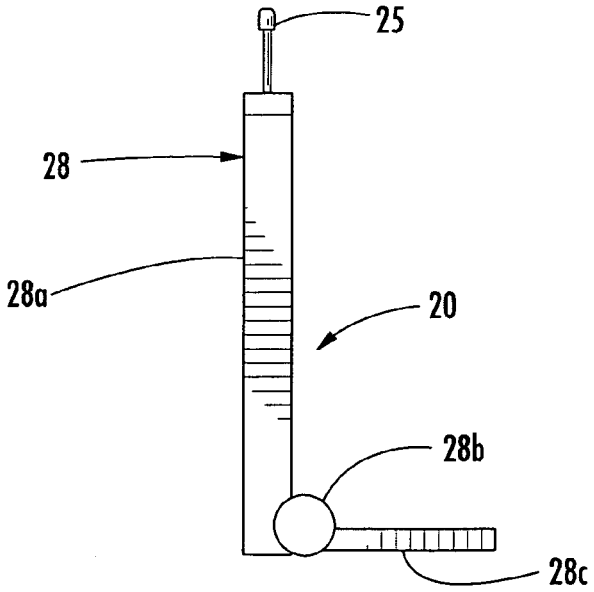
FIG. 5 is a side elevation view of an adjustable built-in stand that can be used for holding the radio receiver and display unit.

The radio receiver and display unit 20 includes a visual display 22 that is operative with a wireless radio receiver 24 that receives signals via antenna 25. The display 22 includes indicia 26 that are actuated via a processor 27 (FIG. 6) by wireless transmitter signals from the tow bar handle and indicative of a skier down condition and each of the desired water skier conditions. The radio receiver and display unit 20 is preferably built in one non-limiting example as an integral unit that is placed on an adjustable, built-in stand 28 that can be tilted in any desired angular direction to enhance the viewing angle by the boat operator (FIG. 5). The built-in stand 28 can include a back support 28*a*, pivot mount 28*b* and horizontal support 28*c*, which can be attached to a support on the boat.

Figure 2:
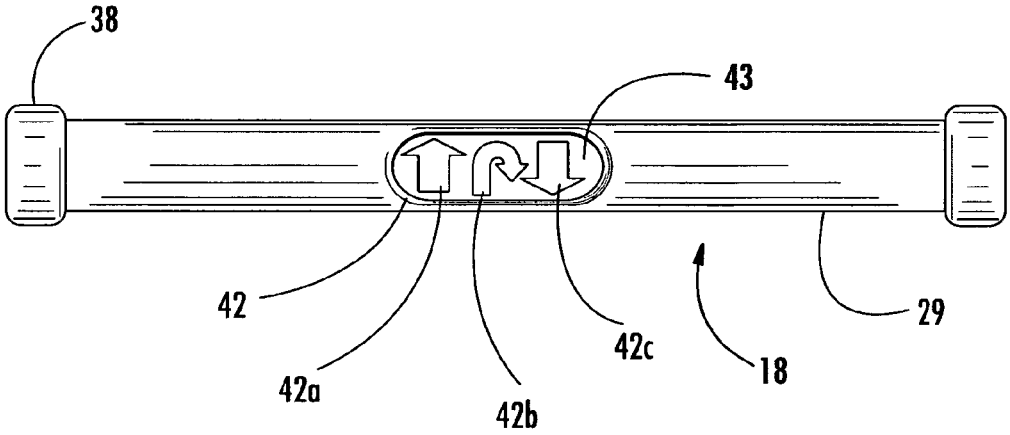
FIG. 2 is a more detailed view of the water skier tow bar handle assembly and showing the end cap and control actuators.
Figure 3:
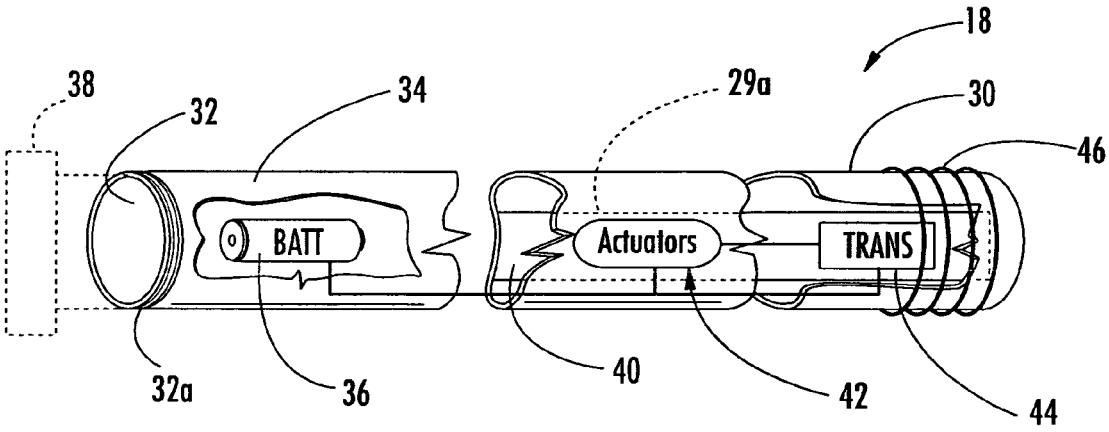
FIG. 3 is a fragmentary drawing of the water skier tow bar handle assembly, showing various components including the pressure sensor, battery compartment and battery, control actuators, wireless radio transmitter, and antenna.

The water skier tow bar handle 18 is formed as an assembly of component parts as a cylindrically configured and longitudinally extending member to which the tow rope 16 is secured for towing the water skier. As shown in FIGS. 2 and 3, the tow bar handle assembly defines a surface having a grip portion 29 over which the fingers and hands of a water skier clasp. This grip portion 29 can be formed from rubber or other similar grip material that enhances the water skier grip on the handle. This grip material is formed, in one aspect of the present invention, over a cylindrically configured and longitudinally extending body member 30 (FIG. 3), which contains the various components of the tow bar handle assembly.

As illustrated, the tow bar handle 18 has at least one open end 32 and defines a battery compartment 34 within the interior of the body member 30 for receiving at least one battery 36. A battery compartment cover is formed in this illustrated aspect of the present invention as an end cap 38 and is removably mounted on the open end 32 of the tow bar handle. It holds the at least one battery within the battery compartment. Naturally, the end cap is water sealed when positioned over the open end and can include threads for sealingly engaging threads 32*a* positioned on the open end of the handle. It is possible that the battery compartment could be formed with a side access panel.

The grip portion 29 includes a front grip portion 29*a* having a pressure sensor 40 positioned at that location and sensitive to hand and/or finger pressure exerted by the water skier. The pressure sensor 40 can be formed as a longitudinally extending pressure strip, as illustrated in FIG. 3, which extends along the front grip portion 29*a*. This strip can be embedded in the rubber or other grip material or on the outer surface. The pressure sensor 40 could also be positioned under the grip material forming the grip portion and against the body member 30.

Control actuators 42 are positioned along the rear grip portion 29*b* facing the water skier and indicate through user actuation a desired water skier condition, such as a water skier desire to speed up, slow down, or turn around. In one aspect of the present invention, these control actuators are pressure actuated control buttons that respond to pressure exerted by the water skier. As illustrated, three control buttons 42*a*, 42*b* and 42*c* are illustrated that are user actuated for indicating speed up, turn around, or slow down. In one aspect of the invention, each button is positioned about ⅛ inch below the surface of the handle in an open slotted area 43 formed within the grip material and the cylindrically configured body member 30. Each button, however, could be formed flush or some other depth instead of ⅛ inch. In one aspect of the invention, the buttons 42*a*, 42*b*, 42*c* are configured as an up arrow to indicate a speed up for the desired water skier condition, a down arrow to indicate a slow down for the desired water skier condition, and a 180° arrow turn to indicate a turn around condition.

As illustrated, a wireless radio transmitter 44 is positioned and sealed in a waterproof manner within the tow bar handle and is operatively connected to the battery 36 mounted within the battery compartment 34, the pressure sensor 40, and the control actuators 42 for generating wireless signals to the radio receiver and display unit 20 indicative of a skier down condition when pressure is no longer exerted on the pressure sensor 40 and desired water skier conditions after skier actuation of the control actuators 42.

An antenna 46 is operatively connected to the wireless radio transmitter 44. It can be mounted on or inside the tow bar handle 18, or at other locations suggested by those skilled in the art. In one aspect of the invention, it is mounted as a coil wound over the tow bar handle, as illustrated. Although any number of wireless radio transmitters can be used in the present invention, a simple spread spectrum wireless transmitter that is operative within unlicensed bands established by the Federal Communications Commission or an FM or other similar wireless radio transmitter could be used. The electronics associated with the wireless radio transmitter include basic electronic circuitry known to those skilled in the art for generating wireless signals indicative of a skier down condition or desired water skier conditions, such as a wireless signal indicative of speed up, a wireless signal indicative of slow down, or a wireless signal indicative of a turn around condition. These wireless signals could form many types of modulation, such as a simple on/off pulse modulation as in Morse code, or the more complicated modulation and coding arrangements for indicating the desired water skier conditions and skier down condition.

The control actuators 42*a*, 42*b* and 42*c* can be color coded for indicating the desired conditions and to facilitate any water skier's selection of the control actuators based on a color difference. For example, the speed up control actuator 42*a* could be green, the slow down control actuator 42*b* could be yellow, and the turn around control actuator 42*c* could be blue.

The display 22 of the radio receiver and display unit 20 acts as a gauge to indicate the skier down condition or indicate a change in the desired water skier conditions after a water skier actuates the control actuators 42 or the water skier lets go of the tow bar handle, and thus, the pressure sensor, such as when the skier falls. In one aspect of the present invention, the display 22 is formed as a liquid crystal display (LCD) and includes indicia 26, such as four icons, each indicative of what the water skier has actuated, such as stop sign icon 50*a* that is indicative of the skier down condition, and icons 50*b*, 50*c* and 50*d* that are configured similar to the indicia of the control actuator buttons, as illustrated, which indicated the speed up, slow down, or turn around desired skier conditions. It should be understood, however, that any number of different icon designs or other indicia configurations can be used for both the indicia on the display and the control actuators on the tow bar handle.

In one preferred aspect of the present invention as illustrated, simple designs, such as the illustrated stop sign and arrows, are used. The LCD can be a color LCD display and the indicia 26, e.g., the icons, can be color coded in the same color as the control actuators. The stop sign icon can be the color red and can light when the skier is down and has dropped the tow bar handle. Additionally, the display could be an LED, instead of an LCD, depending on cost.

Each icon or other indicia 26 used on the display can blink five times to aid in capturing the boat operator's attention and allowing the boat operator to observe that a condition has changed. The display could be programmed such that the icons blink fewer than five times, or greater than five times, as desired, by individual action and choice.

In another aspect of the present invention, an alarm 54 is operatively connected to the wireless radio receiver and display unit 20 (FIG. 4) and can sound for three seconds for each action, indicating a change in water skier conditions, such as speed up, slow down, or turn around. The alarm 54 can sound for a longer, five second period, indicative of a skier down condition, which is more important and demands immediate attention by the boat operator. Each condition change indicated on the display could have its own distinctive tone or series of tones when the alarm is generated. Thus, it is possible that the boat operator would not have to look down at the display to determine what condition has changed.

Figure 6:
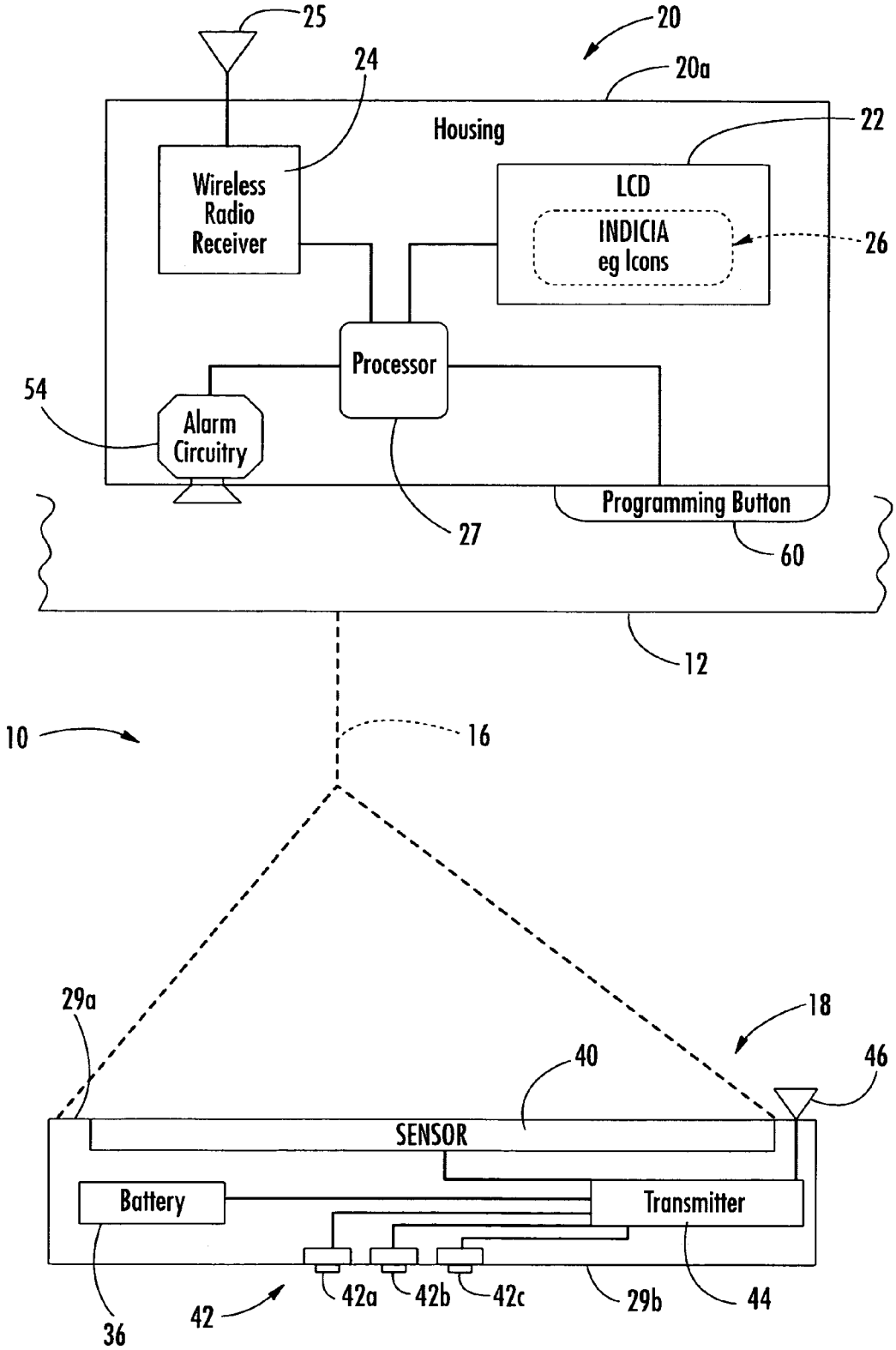
FIG. 6 is a block diagram showing one example of the type of circuits that can be used with the water skier alert system.

FIG. 6 illustrates a schematic block diagram of the skier alert system 10 showing the radio receiver and display unit 20 and the tow bar handle 18. As illustrated, the tow bar handle 18 includes the previously discussed components, including the battery 36, wireless transmitter 44, pressure sensor 40, antenna 46 and control actuators 42 as three buttons that can be selected by the water skier for actuating the transmitter to transmit a wireless signal.

Figure 4:
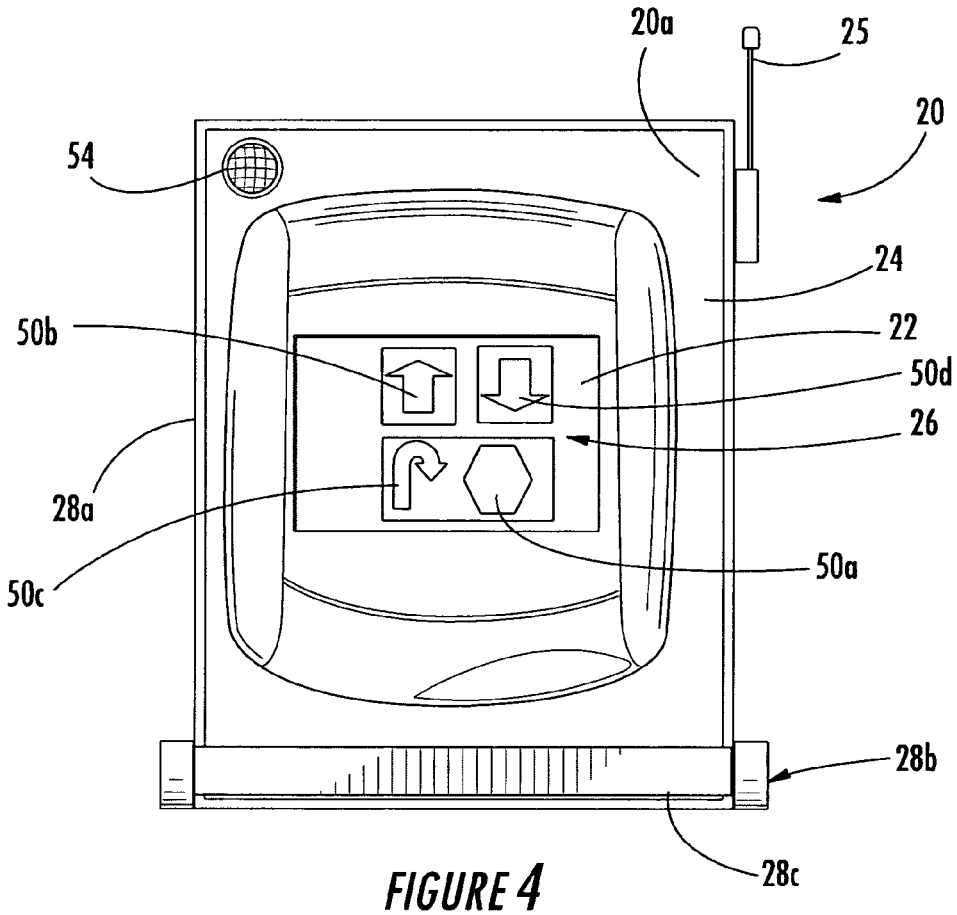
FIG. 4 is an elevation view of the display and receiver.

The radio receiver and display unit 20 includes a housing 20*a*, as also illustrated in FIG. 4, supporting the LCD display 22 with the various indicia 26, e.g., icons. The radio receiver 24 is connected to the antenna 25 and receives signals from the tow bar handle 18. A microprocessor 27 or other controller is connected to the wireless radio receiver 24 and the LCD 22 and generates the appropriate signals for displaying the proper icons on the display. A series of programming buttons or a simple one touch programming button 60, as illustrated, is operatively connected to the microprocessor 27 and allows a user to program the display and alarm system for actuating different types of icons and different audible alarms. These components can be selected and configured in a circuit design as known to those skilled in the art.

Figure 7:
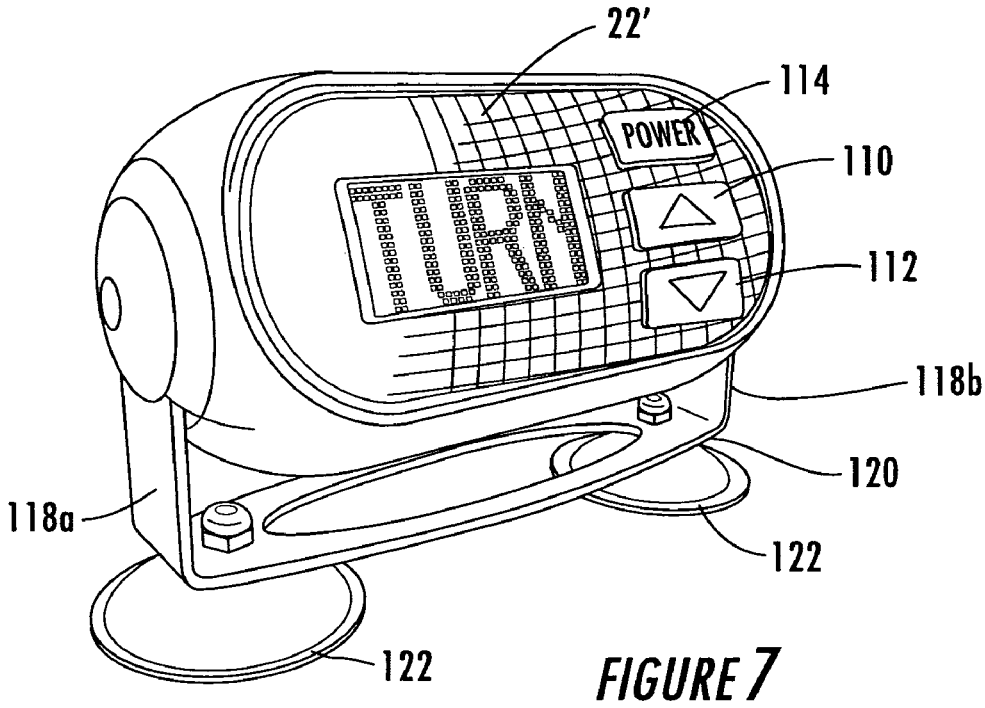
FIG. 7 is an isometric view of the display and receiver in accordance with a second embodiment and showing the alphanumeric display.
Figure 8:
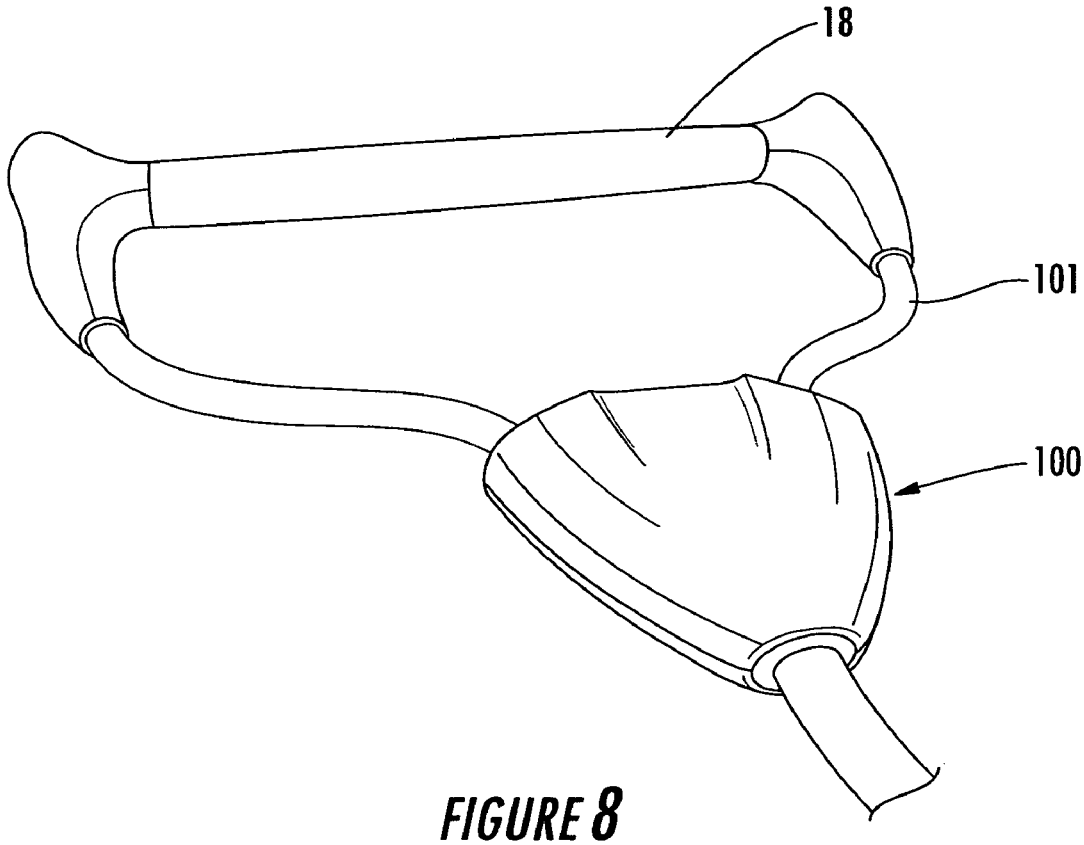
FIG. 8 is an isometric view of the tow bar handle and the floating assembly, which contains many of the electronics previously incorporated in the tow bar handle in the first embodiment of FIGS. 1–6.
Figure 9:
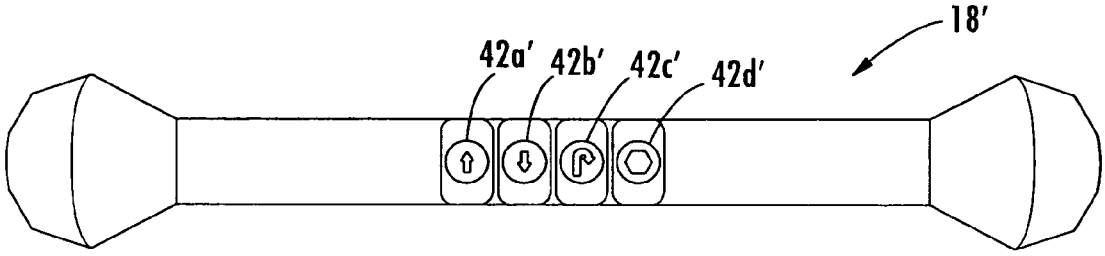
FIG. 9 is an elevation view of the tow bar handle and showing control actuators that extend about 180 degrees around the handle.
Figure 10:
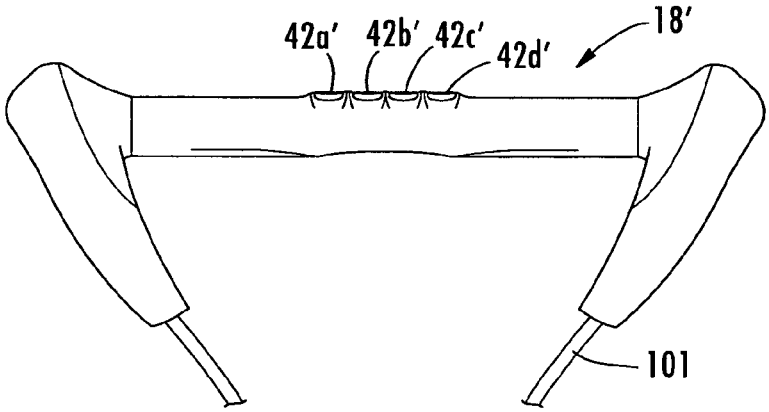
FIG. 10 is a top plan view of the tow bar handle and showing a portion of the control actuators.
Figure 11:
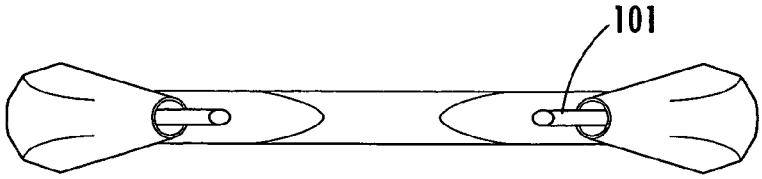
FIG. 11 is a rear elevation view of the tow bar handle.
Figure 12:
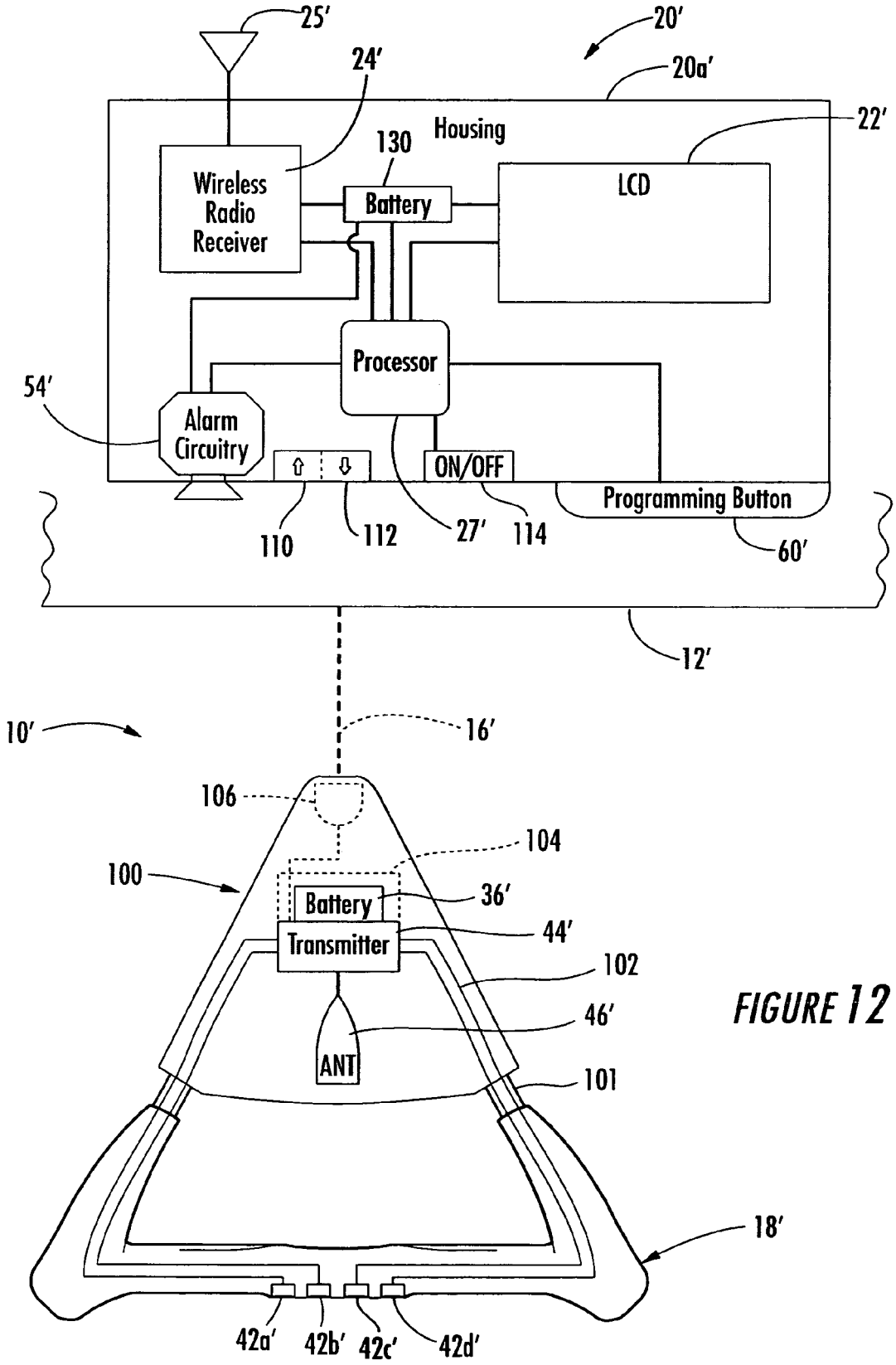
FIG. 12 is a block diagram showing one example of the type of circuits that can be used for the water skier alert system in accordance with the second embodiment and showing the float assembly that incorporates the electronic components, including the wireless transmitter.

FIGS. 7–12 illustrate a second embodiment of the present invention where the electronics previously incorporated in the tow bar handle 18, as shown in FIGS. 1–6, are positioned in a float assembly 100 as shown in FIGS. 8 and 12. For purposes of clarity, in the description of this second embodiment, similar functional elements as set forth in FIGS. 1–6 are described with reference numerals using prime notation. The float assembly 100 is connected to the tow bar handle 18' by tow bar ropes 101. The tow bar handle 18' can have a grip as in the previous embodiment. As shown in FIGS. 9 and 12, the control actuators are shown as four control actuators formed as buttons 42*a*', 42*b*', 42*c*' and 42*d*' that are formed similar to control actuators explained relative to the embodiment shown in FIGS. 1–6. In this present embodiment, however, the buttons extend about 180° around the tow bar handle 18' to make it easier for the water skier or other aquatic user of the tow bar handle to see the buttons even when the user holds the tow bar handle near the waist, as sometimes a user will do in aquatic sports. The control actuators as four buttons 42*a*', 42*b*', 42*c*' and 42*d*' are formed as separate buttons corresponding to the indicated up, down, turn and stop directions. Instead of a stop button, there could be two turn buttons, one for the left turn and the other for the right turn. The control buttons could be color coded or have no indicia.

The four buttons 42*a*', 42*b*', 42*c*' and 42*d*' are operatively connected to wiring 102 that extends through the tow bar handle 18' to the float assembly 100, which includes the transmitter 44', battery 36' and antenna 46'. The battery 36' could be inserted within the float assembly 100 via a removable access cover 104. The sensor is not included in this particular embodiment, but could be as indicated by the dashed lines 106. The sensor is particularly not advantageous if a user is on a craft being pulled and grabs the tow bar handle 18, which often would contact the water.

As shown in FIGS. 7 and 12, the radio receiver and display unit 20' could be formed as an attractive display having a face with an alphanumeric display 22' that would display the various instructions from the water skier operating the control actuators, such as turn, up (faster), down (slower) and stop. Other control buttons, such as up and down volume control buttons 110,112, could be operative with the alarm circuitry 54' either directly with that circuitry or through the processor 27' to control the volume of the alarm. The up and down buttons could also be operative with a programming button or other functional circuitry to program various functions.

The housing 20' shown in FIG. 7 is substantially cylindrically configured and includes a flat face on which the alphanumeric display 22' is formed, together with the up and down control buttons 110,112 and an on/off button 114. The housing could be mounted on a stand 116 as shown in FIG. 7, which includes two upstanding leg supports 118*a*, 118*b* mounted to a base 120. Suction cups 122 can be used to secure the base and the housing 20' on a dash. The circuit could include a battery 130 (FIG. 12) for turning the radio receiver and display unit on and off by powering the wireless radio receiver 24', alarm circuitry 54', processor 27' and display 22'.

Other common components as shown in FIG. 12 that are similar to the embodiment shown in FIG. 6 include the wireless radio receiver 24', antenna 25', processor 27' and the programming button 60' that could be used in some instances. The alphanumeric display 22' uses alphanumeric characters instead of icons. It should be understood, however, that icons can also be used.

Figure 13:
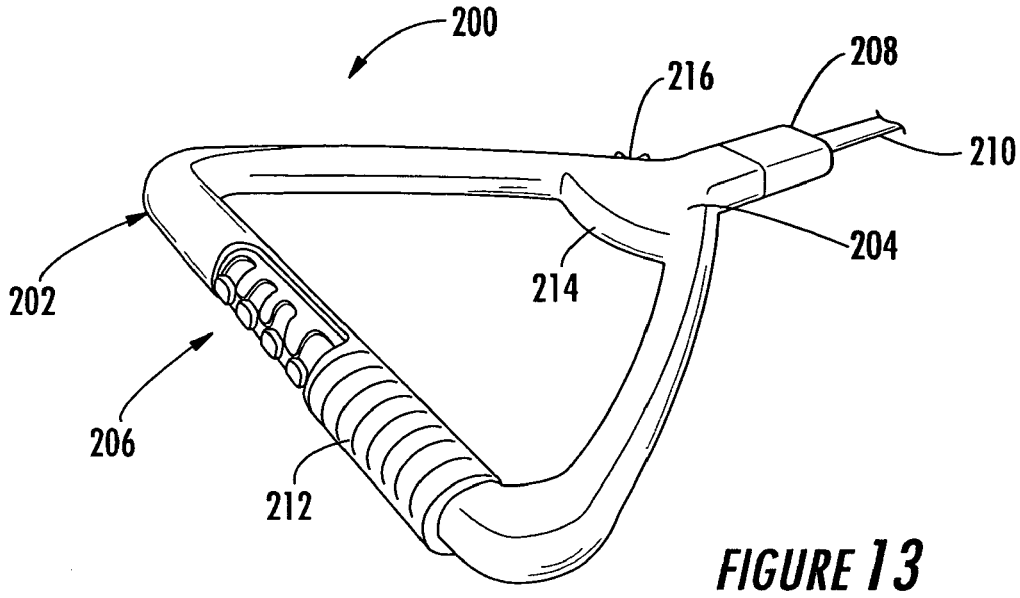
FIG. 13 is a isometric view of another embodiment of the tow bar assembly that includes a tow bar handle and housing connected to the tow bar handle and a wireless radio transmitter mounted within the housing, and having the components similar as in the embodiments of FIGS. 1–12.
Figure 14:
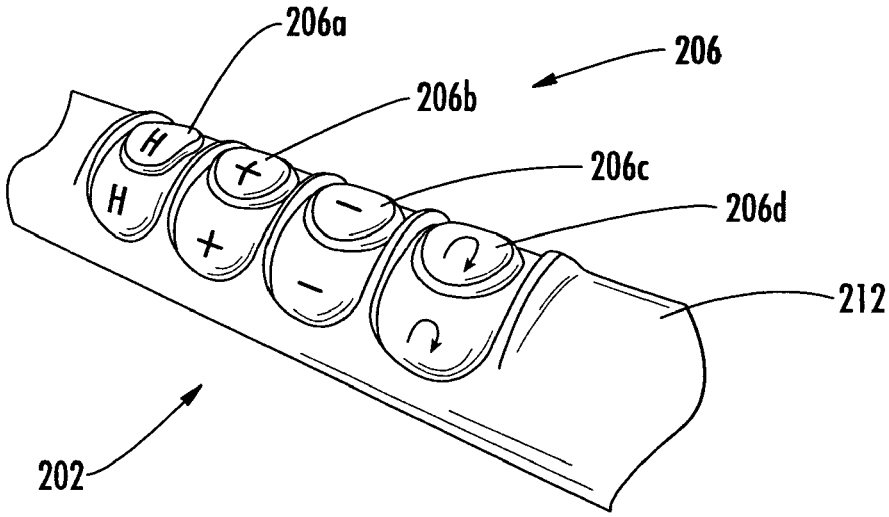
FIG. 14 is an enlarged isometric view of the tow bar handle and showing in detail its control actuators.

FIGS. 13 and 14 show another embodiment of a water skier tow bar assembly 200 in accordance with the present invention, which includes a tow bar handle 202 and a housing 204 connected to the tow bar handle. The wireless radio transmitter such as the type described with reference to previous embodiments is mounted within the housing 204 and operably connected to the control actuators 206. The housing 204 can be integrally formed with the tow bar handle 202, for example, formed in this non-limiting example as a carbon fiber assembly in a triangular configuration as shown in FIG. 13. The housing 204 includes a rubber support grommet 208 that connects to a tow rope 210.

A rubber grip 212 is formed over the tow bar handle 202 as illustrated in FIG. 13. The battery compartment in this embodiment is built into the housing 204 and includes a battery cover 214 at an interior portion of the formed triangle. The tow bar assembly 200 as illustrated can include a "deadman" wet switch, shown diagrammatically at 216, which is activated when the tow bar assembly is submerged in water, for example when a skier falls. This switch could be formed by different sensors or other means. In one non-limiting example, it can be embedded metal probes about 5 mm apart on the front side of the housing containing the wireless radio transmitter. Upon activation of the switch 216, the wireless radio transmitter is turned "ON" and transmits a wireless radio signal indicative of a skier down condition. In this embodiment, as with the previous embodiments of FIGS. 1–12, the tow bar handle 202 includes raised buttons forming the control actuators. A skier presses one of the buttons to send a command to a boat operator over a wireless radio signal from the transmitter. The receiver, for example such as the type shown in FIG. 7, receives a command sent by the skier and displays the command on an LCD display. Audio alarm tones can also be generated to alert the boat driver, for example, by using an alarm and speaker 54' as shown in FIG. 12.

The control actuator 206 and wireless radio transmitter are battery powered, and depending on the type of battery, can have a battery life of up to 30 hours minimum. The entire structure forming the tow bar assembly 200 in this example is preferably formed from a carbon fiber composite or similar lightweight, but strong material. All components are mounted inside a carbon fiber composite (or other material) tube, including an extended tube portion forming the housing 204 as shown in FIG. 13. Four embedded buttons 206*a* 206*a–d* are formed, with the button symbols raised such that they can be viewed 180°. The "deadman" or "wet" switch 216 as noted before is located in one embodiment at the front of the housing, but can be located on the tow bar handle 202, another section of the housing 204, or the connecting pieces between the two, and will trigger the fallen skier alarm.

The carbon fiber composite or other similar material forms a design that is lightweight, allowing the entire tow bar assembly 200 to float. It is a waterproof design and preferably strong enough to withstand water depths up to 10 meters and a maximum load of about 270 Kg. Typically, the tow bar assembly 200 may include a five foot section of tow rope to connect to a main tow rope forming a ski line. This extension piece of tow rope can be any desired color, but black and silver has been found to be an acceptable color because of its contrasting colors that can be readily visible as it shimmers within the water. Each wireless radio transmitter preferably has a unique address. In one non-limiting example, there could be 81 address combinations. A four-position, tri-state switch positional in a battery compartment could set an address code. This switch could be addressable through a screw positioned on an end cap or cover for the battery compartment, for example, on the housing, and connected to the wireless radio transmitter mounted therein.

The receiver design used for this embodiment would be similar, of course, to the receiver design shown in FIGS. 7 and 12. Further details of the receiver are advantageous and applicable to all embodiments. The receiver could include circuitry for detecting the battery power level at both the wireless radio transmitter and the receiver. The receiver display can be any size, but typically a large LCD dot matrix display of about 42 mm×22 mm has been found acceptable. The receiver can have a dual power operation with an internal 9 volt battery or external 12 volt battery (auxiliary power source) housing mounted plug with a rubber cover to prevent water intrusion. Data content backup can be accomplished using this design.

Figure 15:
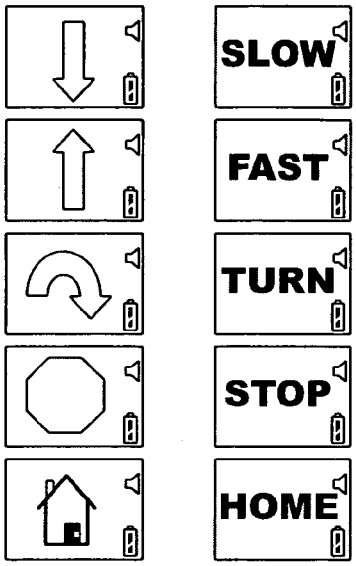
FIG. 15 is a table showing the different symbols and text that could be displayed on a receiver corresponding to different commands transmitted from the wireless radio transmitter at the tow bar assembly.

The receiver typically operates on a single RF channel using an FCC approved frequency, for example, a spread-spectrum channel that does not require a site license from the FCC. The receiver would typically include a built-in antenna, and a built-in waterproof alarm or buzzer with a sound pressure of about 100 dB at 12 inches, in a non-limiting example. The receiver can receive different commands and have different visual command indicators, in either symbol or text. FIG. 15 is an example of five different commands, with each command having its own unique alarm tone pattern. As non-limiting examples, the receiver can have an adjustable sound level of alarm tones, with the exception of a fallen skier alarm in which the sound level will be maximum to indicate the more critical skier down position. Alarm tones could be disabled, with the exception of the fallen skier alarm, in which the sound alarm level will be maximum.

The receiver has a water resistant design, and as illustrated in FIG. 7, includes a pivot mount base with suction cups 122 for temporary mounting to a windshield or other support surface. The receiver can be hung upside-down or placed right-side-up and swiveled into any desired position. Each receiver also has a unique address with 81 address combinations, similar to the wireless radio transmitter, in this non-limiting example. A four-position, tri-state switch (not shown) inside the receiver battery compartment can be used to set the address code to match the code set for the wireless radio transmitter at the tow bar assembly. Any wireless radio signals received from another wireless radio transmitter for another skier towed by a different boat would not interfere with operation of the instant tow bar assembly and receiver.

As non-limiting examples, there can be up to five user selectable commands, including (1) speed up; (2) speed down; (3) turn; (4) home; (5) and "stop," for example the last stop command being actuated by the switch 216. FIG. 14 shows the different buttons 206*a–d* operating as respective a) home, b) speed up, c) speed down, and d) turn. The commands can be sent whenever the corresponding button on the tow bar handle 202 is pressed. A stop signal is initiated when the tow bar assembly 200 engages the water, such as when the skier falls. In one non-limiting example of the present invention, the wireless radio transmitter can stop transmission 20 seconds after it is in water.

The receiver can display commands received by either graphic symbols or text. For example, to choose between symbols or text, a user can press and hold the "UP" and "DOWN" buttons simultaneously for three seconds. The word "FAST" will blink on the display. The "DOWN" button can be pressed and an upward arrow blinks on the display. The "UP" button can be displayed and "FAST" blinks in the display. The currently blinking symbol or text would be the setting. The display can return to the normal mode after five seconds if no buttons are pressed. FIG. 15 shows the symbols and text corresponding to the commands as described above.

Figure 16:
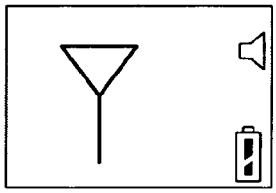
FIG. 16 are screens showing symbols that can be displayed at the receiver when the receiver is initially turned "ON."
Figure 17:
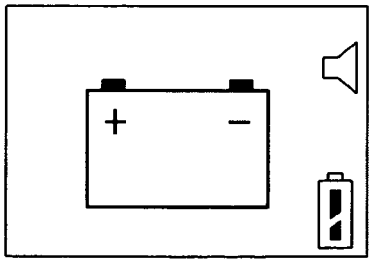
FIGS. 17 and 18 are screens that could be displayed at the receiver indicating that battery voltage is being monitored.
Figure 18:
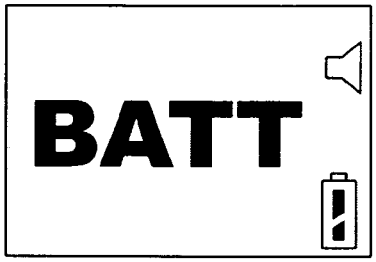

When the receiver is on, it can scan for a transmission from the wireless radio transmitter in a tow bar assembly. The display could flash when the receiver is searching for a transmission. When the receiver responds to the wireless radio signals generated at the tow bar assembly with the same address code, the screen in FIG. 16 could appear and stay illuminated until a command is entered by a towed user. Battery voltage is always monitored and when it drops below a pre-set value, the wireless radio transmitter can transmit a command through the receiver automatically indicating it is low on battery power. This could be important because a dead battery would make transmission of the critical "skier down" signal almost impossible. The display on the receiver will blink one of the following screens as shown in FIG. 17 or 18, depending on whether the receiver is set to graphics (FIG. 17) or alphabetic (FIG. 18) display.

As shown, three power buttons are shown on the front of the receiver as a power button, UP button and DOWN button (FIG. 7).

The display on the receiver is typically a liquid crystal display (LCD) formed as a dot matrix display, and can have a resolution of about 36 by 17 dots. This type of resolution has been found adequate for use. Symbols and text can be displayed, and in one example, three different icons can be shown on the right side of the display. For example a battery icon can indicate when an internal battery is exhausted, for example if the battery is shown without a solid internal shading. A full battery can be indicated such as in FIGS. 17 and 18. The upper right hand corners of the display screens of FIGS. 17 and 18 show an alarm signal that is ON but can be muted when an "X" is drawn through it such as is shown in FIGS. 19*e* and 19*f*.

A fallen skier can be indicated using the present invention. An alarm will sound at its pre-set value and a stop indicator will typically appear on the display. Pressing any button on the receiver during the fallen skier alarm will mute the alarm. In one example, "STOP" and "MUTE" alternate on the display at a rate of about 0.5 seconds. The alarm remains muted until the wireless radio transmitter is removed from the water and the fallen skier trigger deactivated. Pressing any button again on the receiver returns the volume setting to its pre-set level.

Preferably there are two alarm tones, i.e., a high-pitch tone and a low-pitch tone. Any type of audible frequencies can be used as long as a person can hear the tones during boat operation. Different alarm tone patterns can be used for different alarm conditions. For example, when a skier has fallen, a continuous high-pitch tone at maximum loudness is generated. For a SPEED-UP condition, a high-pitch alarm tone can sound for 0.7 seconds followed by 0.3 seconds of a low-pitch alarm tone at a pre-set loudness. A SPEED-DOWN condition can be indicated by a high-pitch alarm tone for 0.3 seconds followed by 0.7 seconds of a low-pitch alarm tone at a pre-set loudness. For a TURN condition, a one second low-pitch alarm tone at a pre-set loudness can be generated followed by a 0.5 second silence. For the HOME condition, a 0.5 second high-pitch alarm tone can be followed by a 0.5 second low-pitch tone at a pre-set loudness. Naturally, these are only non-limiting examples that users have found acceptable.

The wireless radio transmitter can be powered ON and OFF using different techniques. For example, the wireless radio transmitter can be turned ON when any button is pressed on the tow bar handle. The wireless radio transmitter can also turn OFF after ten minutes of no button being pressed. As to the receiver, it can be turned ON when the power button is pressed and turned OFF when the power button is pressed and held for three seconds. The word "OFF" is displayed automatically on the display. Automatic power OFF can occur when no wireless radio signal is received for about 15 minutes.

Figure 19A:
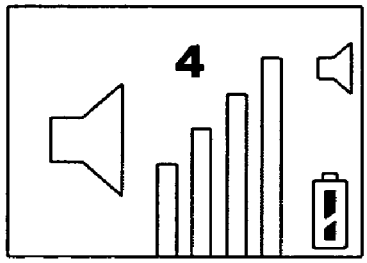
FIGS. 19*a* through 19*f* are different screens that could be displayed at the receiver indicating different volume levels for the alarm.
Figure 19B:
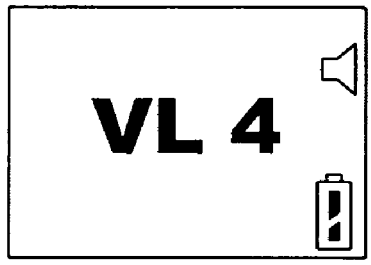
Figure 19C:
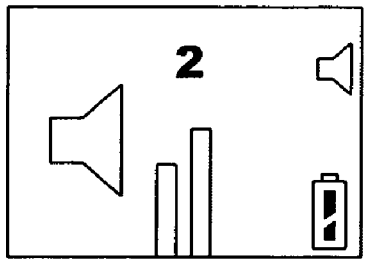
Figure 19D:
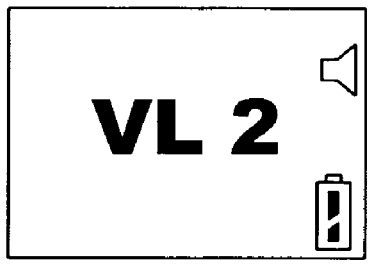
Figure 19E:
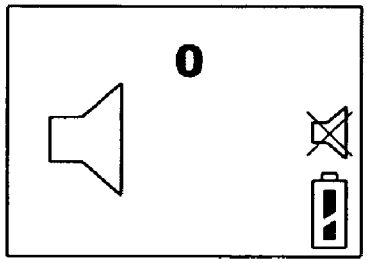
Figure 19F:
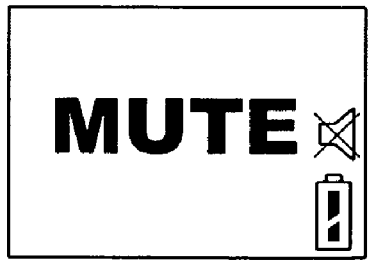

FIGS. 19*a* through 19*f* show various alarm volume levels that be displayed on the receiver display. For example, by pressing UP, the volume level can be increased by one out of five volume levels in this non-limiting example. FIGS. 19*a* and 19*b* show typical LCD display screens in which the alarm will sound for five seconds at a selected volume level, for example, shown as volume level four. The DOWN button can be pressed to decrease the volume level by one. Volume level two is shown in FIGS. 19*c* and 19*d* and an alarm will sound for five seconds at a selected volume level. When the volume level is at zero, the speaker is muted as shown in FIGS. 19*e* and 19*f*.

Figure 20:
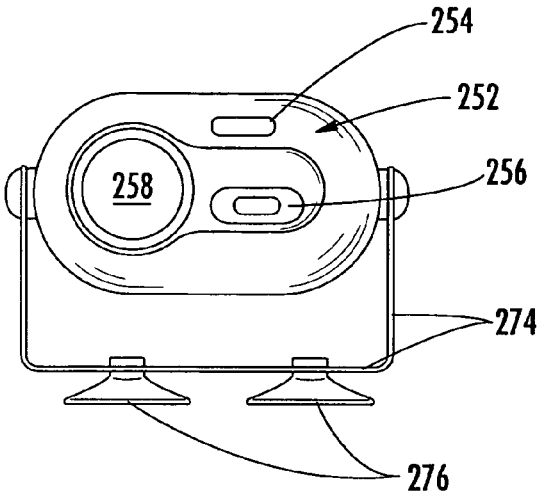
FIG. 20 is a front elevation view of another embodiment of a receiver that can receive wireless radio signals transmitted from a wireless radio transmitter to indicate a water skier down condition.
Figure 21:
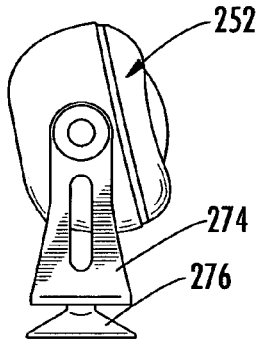
FIG. 21 is a side elevation view of the receiver shown in FIG. 20.
Figure 22:
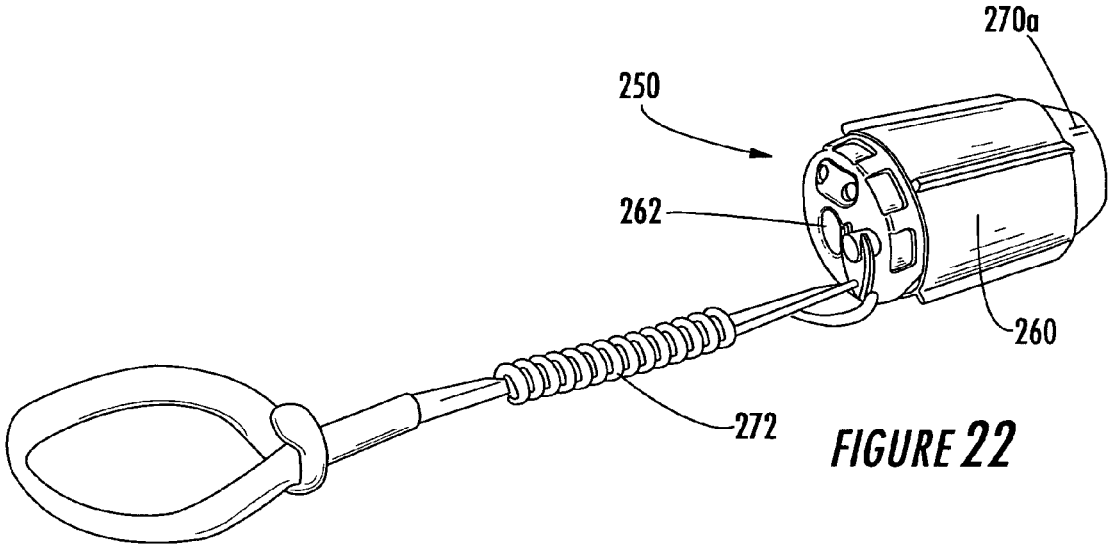
FIG. 22 is an isometric view of another embodiment operative with the receiver shown in FIGS. 20 and 21, and showing a float assembly that can be carried by a tow rope, and a wrist strap that can be attached to a user such that when the user falls, a switch is activated at the float assembly to transmit a wireless radio signal indicative of a skier down condition.
Figure 23:
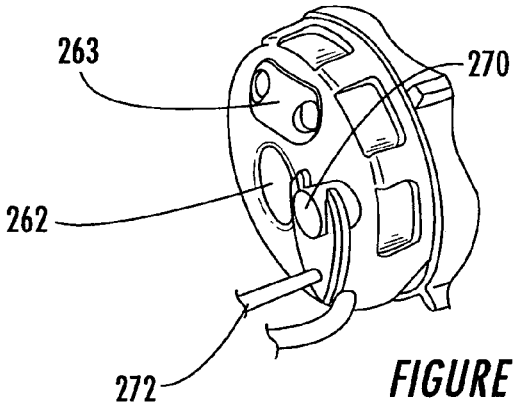
FIG. 23 is an isometric and enlarged end view of the float assembly shown in FIG. 22 and showing how the wireless radio transmitter is initiated by pulling out the switch when the user falls.
Figure 24:
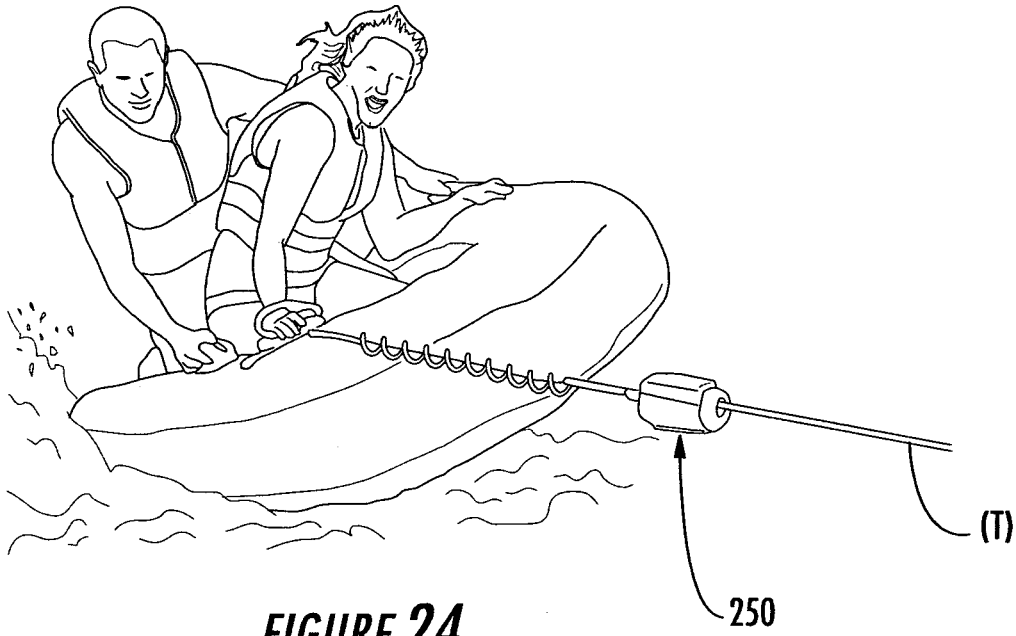
FIGS. 24 and 25 are isometric views showing the float assembly in use with a respective view of a raft and a water skier in accordance with the present invention.
Figure 25:
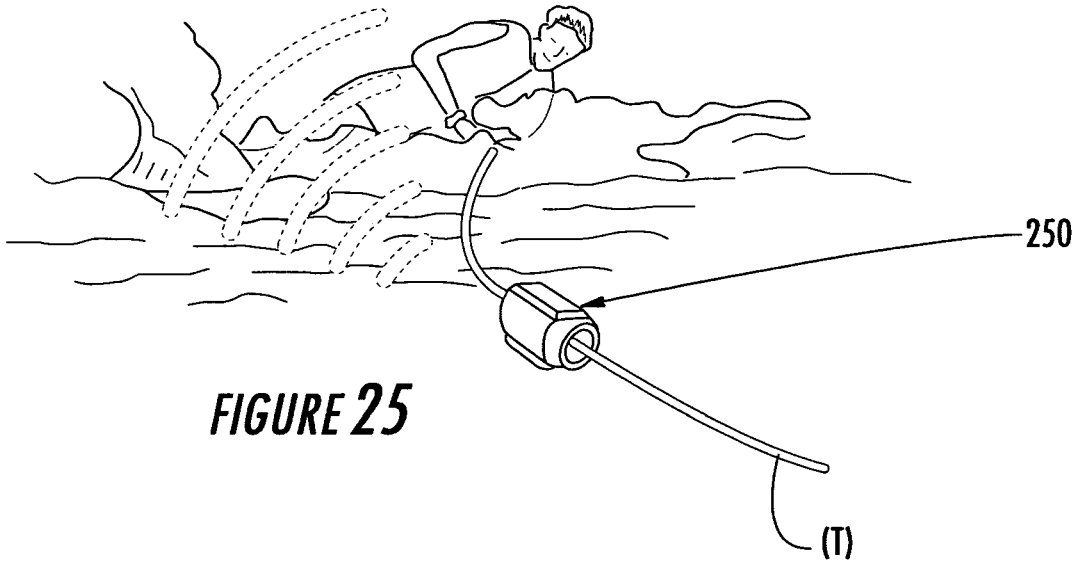

FIGS. 20–23 show another embodiment of the present invention in which a float assembly 250 shown in FIGS. 22 and 23 is adapted to be carried by a tow rope used for towing a water skier or towing a raft or other aquatic device, for example, such as the raft shown in FIG. 24. A receiver 252 that receives wireless radio signals from the float assembly 250 is shown in FIGS. 20 and 21, and is a more simplified receiver design then previously described with the embodiments of FIGS. 1–19. This receiver 252 has an LED 254, and one control button 256, and an alarm or buzzer 258 that generates an audible alarm when a skier falls, indicating the skier down condition. The water skier float assembly 250 includes a housing 260 formed as a float and having an aperture 262 through which a tow rope (T) passes to permit the housing to be carried by a tow rope that pulls a skier or aquatic device, such as a raft (FIGS. 24 and 25). A wireless radio transmitter (not shown in detail) is mounted within the housing 260 for transmitting wireless radio signals indicative of a skier down condition. A battery cover 263 is positioned over a battery compartment, which holds the appropriate battery for powering the wireless radio transmitter. The battery cover 263 can be secured by screws or other means. The wireless radio signals can be transmitted after a skier falls, indicative of the skier down condition. The housing could include a sensor that senses water and actuates the transmitter, or in the illustrated embodiment of FIGS. 22 and 23, a water activated switch 270 triggers operation of the transmitter. For example, a wrist strap 272 shown in FIG. 22 engages the switch 270 and when a skier falls, the wrist strap 272 is extended because the skier has fallen, but the tow rope continues as the boat moves. The wrist strap pulls the switch 270 outward as shown in FIG. 23. The wrist strap could be worn by a raft user or skier as shown in FIGS. 24 and 25 and function in both instances in a similar manner. This switch 270 could be operable with a "deadman" switch 270*a* formed similar to the switch described relative to FIG. 13, which includes two metal probes about 5 mm apart. Even if the switch 270 is not pulled, but the float assembly is in the water, the radio transmission is made.

This water skier alert system shown in FIGS. 20–25 is a simplified version of the embodiments shown in FIGS. 1–19. All embodiments, however, could include a water activated switch, to indicate a skier down condition. This more simplified receiver 252 in this non-limiting example of FIGS. 20–25 has a loud warning buzzer or alarm 258 and the one control button 256. A more simplified design for the wireless radio transmitter can be used for this embodiment compared to the other embodiments as shown in FIGS. 1–19, but the circuitry can still be similar. The wrist strap 272 deactivates the water activated switch 270 when the strap is connected. The wireless radio transmitter contained in this housing is also battery powered and has a battery life for about 30 hours minimum depending on the type of battery. The water activated switch 270 can be located on the rear of the housing as illustrated and triggers the fallen skier alarm.

As in previous embodiments, the wireless radio transmitter can operate on a single radio frequency using an FCC approved frequency, including non-licensed spread spectrum communications. The transmitter and receiver could be identified by 81 different address combinations and a four-position, tri-state switch can be used to set the address code as in previous embodiments. The housing is a waterproof design that can withstand depths up to 10 meters and floats.

The more simplified receiver 252 shown in FIGS. 20 and 21 has automatic battery power detection to detect a low battery for both the wireless radio transmitter and receiver. It can operate over a single RF channel on an FCC approved frequency with a built-in antenna and the built-in waterproof alarm or buzzer 258 that sounds pressure at 100 dB at 12 inches in this one non-limiting design. It is water resistant includes a mounting base 274 and suction cups 276 for temporary mounting to a windshield or other support on a boat. This receiver can also be hung upside-down or placed right-side-up. Eighty-one address combinations are possible and a four-position, tri-state switch inside the battery compartment formed preferably at the back and accessible through a cover can set the address code to match the code of the wireless radio transmitter. There is preferably one red LED 254 on the receiver that will light for the skier down condition. The one control button 256 on the front of the receiver typically controls all user functions. For example, to set the alarm volume level, a user could press and hold the button and the alarm will sound at its highest level. Releasing the button will maintain this setting at the current volume level. The user can press and hold the button and the alarm will sound at its second highest level. Releasing the button will set the alarm at the current volume level. The button can be pressed and held again, and the alarm will sound at its lowest level. Releasing the button will set the alarm at its current volume level. It is also possible to press the button and the alarm will mute. The LED will blink one time per second when the alarm is muted. Releasing the button will maintain the setting to the current volume level.

The battery in this receiver can be monitored, and when it is low, the receiver sounds an audible alarm, for example, a chirp every 60 seconds. This chirp reminds the operator to replace the battery. As to the wireless radio transmitter, its battery is monitored, and when it is low, the receiver alarm can chirp two quick times per minute, indicating to the operator that the battery in the float must be replaced.

When the fallen skier condition is detected, such as the wrist strap 272 pulling the switch 270, an alarm can sound at its pre-set volume and the LED 254 can blink at a rapid rate. Pressing the control button 256 on the receiver during a fallen skier alarm will mute the alarm. At this point the LED will blink and that alarm remains muted until the transmitter is removed from the water (fallen skier trigger deactivated). The wireless radio transmitter can be turned ON when the water activated switch 270 is activated, for example with the pulling of the wrist strap on the switch, and will turn OFF when the water activated switch is not active. The receiver can turn ON when the control button 256 is pressed and the alarm sounds at its lowest level for one second. The LED 254 will illuminate. The receiver is OFF when the control button 256 is pressed and held for three seconds. The LED will turn off. Automatic power is OFF when no wireless radio signal is received for 15 minutes.

FIG. 24 shows use of the embodiment in FIGS. 20–23, in which two users of a raft being are pulled by a boat, having its tow rope secured to the front of the raft. The wrist strap is held around the wrist of a user. If the user holding the wrist strap is toppled from the towed raft, the water activated switch will pull and the wireless radio transmitter would be activated to send the wireless radio signal to the receiver, which sounds the alarm indicating the skier down condition. FIG. 25 shows a water skier also using the float of the present invention.

Referring now to FIGS. 26–31, there is illustrated another embodiment of the float assembly 300 having a different configuration than shown in FIGS. 20–25. For purposes of description, reference numerals begin in the 300 series. The housing 302 includes a rope guide 310 mounted on the planar, top portion of the housing. The wireless radio transmitter and similar functional components are mounted in the housing 302 of the float assembly 300, and are similarly designed as described in the previous embodiments. The housing 302 includes a battery compartment and a battery cover 304. A switch mechanism 306 is operative similar to the switch 270 described before and allows actuation of the wireless radio transmitter. A wrist strap or other means could be connected thereto.

Figure 26:
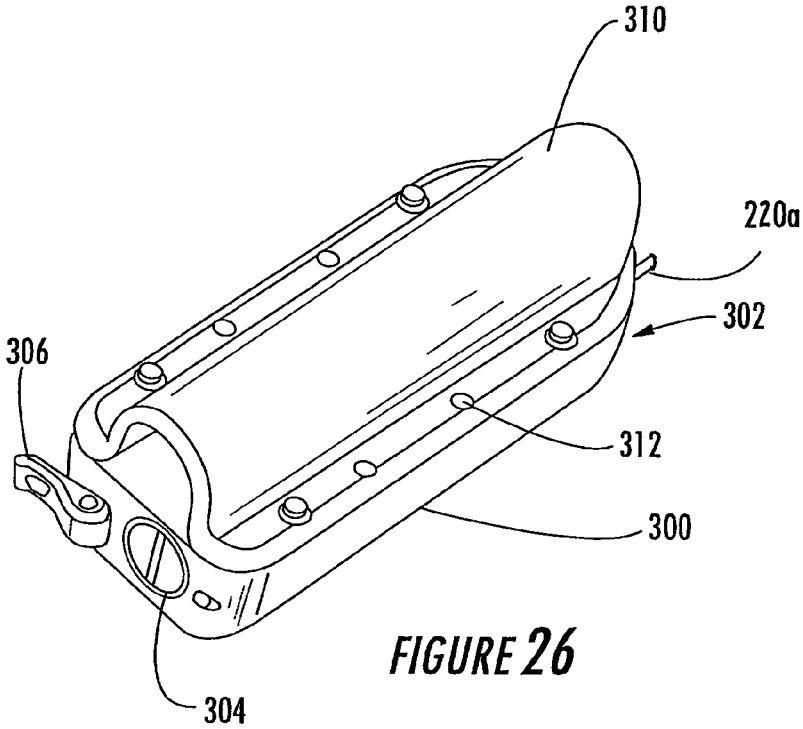
FIG. 26 is an isometric view of another embodiment of the float assembly with a housing and tow rope support (or guide).
Figure 27:
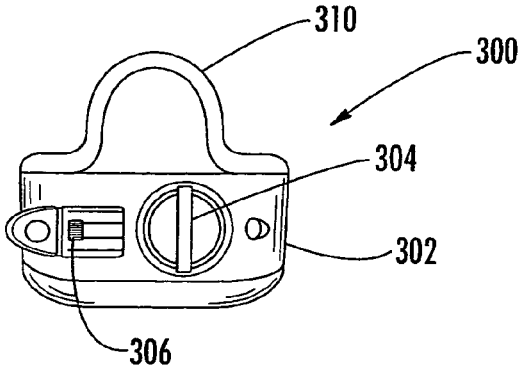
FIG. 27 is an end view of the float assembly looking in the direction of arrow 27 of FIG. 26 and showing the switch for the skier down condition.
Figure 28:
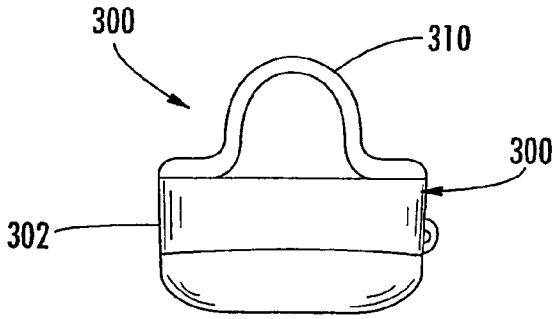
FIG. 28 is an end view looking in the direction of arrow 28 of FIG. 26 and showing the general configuration of the float assembly looking from the front.
Figure 29:
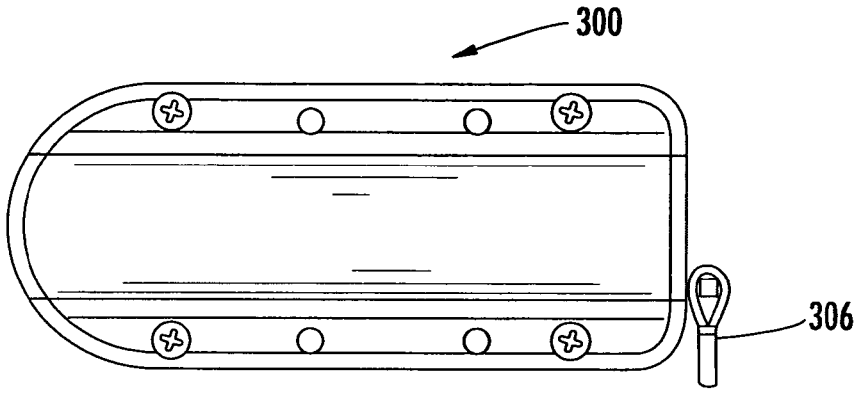
FIG. 29 is a top plan view of the float assembly shown in FIG. 26.
Figure 30:
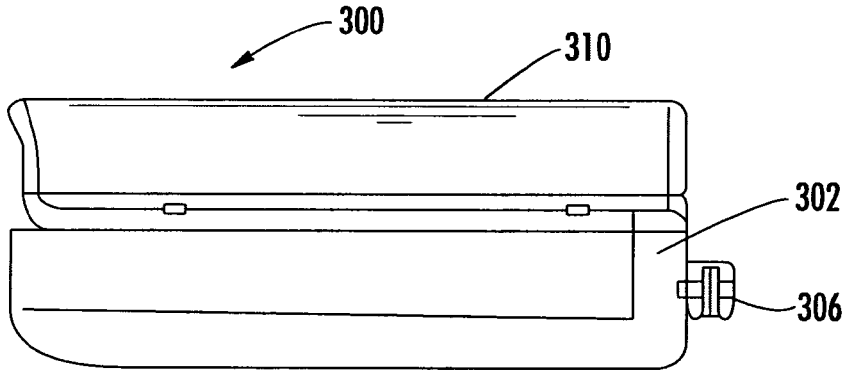
FIG. 30 is a side elevation view of the float assembly shown in FIG. 26.
Figure 31:
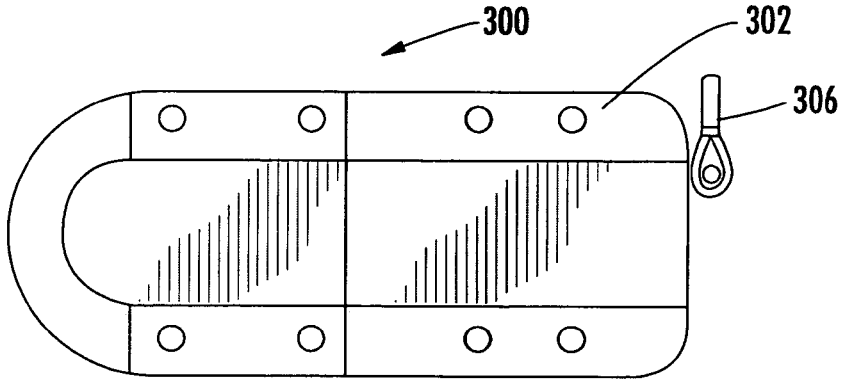
FIG. 31 is a bottom plan view of the float assembly shown in FIG. 26.

As shown in FIGS. 26, 27 and 29, the rope guide 310 is secured by screws 312 or other fastening means to the planar configured top portion of the housing 302. The rope guide 310 is configured to allow a ski rope to pass through the opening formed at the rope guide between the interior portion of the rope guide and the top planar surface of the housing 302. The front of the housing is circular configured to allow it to pass more easily through foam, water or other material and decrease the resistance to water. The bottom of the housing 302 also receives the screws. Two probes **220*a*** could be included as described before. The advantage of this embodiment is a more simple construction in which the rope guide can be positioned on the flat, planar surface of the housing and screwed down to provide a guide for the ropes, as compared to an integrally formed rope guide, as in the previous embodiment, which could possibly be more difficult to manufacture.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A water skier alert system used with a boat towing a water skier via a rope and a skier tow bar handle assembly comprising:

a radio receiver that is adapted to be positioned on a boat towing a water skier for receiving wireless radio signals transmitted from a skier tow bar handle assembly that are indicative of a skier down condition or a desired water skier condition;

an indicator operative with the receiver for indicating a skier down condition or a desired water skier condition as actuated by the wireless radio signals transmitted from the skier tow bar handle assembly; and wherein said skier tow bar handle assembly comprises a tow bar handle and a wireless radio transmitter for generating wireless signals indicative of a skier down condition or desired water skier condition, a water activated switch carried by said wireless radio transmitter that triggers said wireless radio transmitter to transmit a wireless radio signal indicative of a skier down condition, and a wrist strap engaging said switch.

2. A water skier alert system according to claim 1, wherein said indicator comprises an alarm that produces audible tones.

3. A water skier alert system according to claim 1, wherein said indicator comprises a display on the receiver for displaying an indication of a desired water skier condition or a skier down condition.

4. A water skier alert system according to claim 1, wherein said receiver includes an address code identifying the receiver.

5. A water skier alert system according to claim 1, and further comprising control actuators positioned along the tow bar handle and actuated by a user and indicative of a desired skier condition.

6. A water skier alert system according to claim 1, and further comprising a housing supporting the wireless radio transmitter and configured to be carried by a tow rope.

7. A water skier alert system according to claim 6, wherein said housing comprises a float assembly.

8. A water skier alert system according to claim 6, wherein said housing has a hole through which the tow rope passes.

9. A float assembly adapted to be carried by a tow rope used for towing a water skier or aquatic device, comprising:

a housing that is adapted to be carried by a tow rope that pulls a skier or aquatic device;

a wireless radio transmitter contained within the housing for transmitting wireless radio signals indicative of a skier down condition; and wherein said wireless radio signals are generated when a skier or user of an aquatic device falls as a skier down condition.

10. A float according to claim 9, wherein said wireless radio transmitter is operative for transmitting on a single radio frequency (RF) channel.

11. A float according to claim 9, wherein said wireless radio transmitter is operable for transmitting an address code identifying the transmitter.

12. A float according to claim 9, wherein said wireless radio transmitter includes a water activated switch that triggers operation of the wireless radio transmitter for transmitting the wireless radio signal indicative of skier down condition.

13. A water skier float according to claim 12, and further comprising a strap engaging said switch and adapted for connection to a user.

* * * * *